United States Patent [19]

Bozzini

[11] 4,342,992

[45] Aug. 3, 1982

[54] TELEINDICATOR FOR INFORMATION BOARDS

[76] Inventor: Vittorio Bozzini, Via Tolmino 50/16, 10141 Torino, Italy

[21] Appl. No.: 171,094

[22] Filed: Jul. 22, 1980

[30] Foreign Application Priority Data

Jul. 25, 1979 [IT] Italy ..... 68551 A/79

[51] Int. Cl.[3] ..... G08B 5/14

[52] U.S. Cl. ..... 340/764; 40/475; 40/500; 340/815.24

[58] Field of Search ..... 340/764, 378.5, 378.6, 340/315, 317; 40/470, 475, 500

[56] References Cited

U.S. PATENT DOCUMENTS

| | | | |
|---|---|---|---|
| 2,998,596 | 8/1961 | Murphy | 340/808 |
| 3,046,542 | 7/1962 | Hager | 340/346 B |
| 3,418,635 | 12/1968 | Sabulsky et al. | 340/317 X |
| 3,581,182 | 5/1971 | Comstock et al. | 340/317 X |
| 4,117,474 | 9/1978 | Augustine | 340/378.5 X |
| 4,203,094 | 5/1980 | Sowa et al. | 340/378.5 |
| 4,216,471 | 8/1980 | Akred | 340/764 |

*Primary Examiner*—David L. Trafton
*Attorney, Agent, or Firm*—H. Dale Palmatier

[57] ABSTRACT

A teleindicator for information boards is described. The main characteristic of the teleindicator consists in comprising first means for the registration of input signals relating to an indication which has to be presented by the said teleindicator, second means adapted to process the signals from the said first means and to control third means which actuate, in a mechanical way, the display of the said indication by means of indicator elements.

7 Claims, 6 Drawing Figures

TELEINDICATOR FOR INFORMATION BOARDS

BACKGROUND OF THE INVENTION

The present invention relates to a teleindicator for information boards.

At present time, almost all installations for the indication of information, in mean and large size, use either indicator boards comprising plates updatable by rotation and carrying alpha numeric indications, or luminous elements grouped according to geometrical arrangements known as, for example, "matrix 5×7", in which any literal or numeric indication is represented by a particular combination of switched on luminous elements of the said board.

In the boards with luminous elements, since the indication must be readable from a considerable distance, the geometrical dimensions of the radiant surface of each luminous element must be proportionally high; also, a high luminosity is required. These requirements result in a high consumption of electric energy for each single luminous element and require a high electric power to be available for feeding the indication board as a whole.

The known indicators with plates, although requiring a low power value for their operation and permitting a good legibility inasmuch as they bear effective alpha numeric indications, have a disadvantage consisting in the slowness of the updating of the whole indication on the board.

Besides the disadvantages peculiar to each type of known boards it should also be noted that in both cases it is necessary to have at one's disposal a high number of electric connection cables for the transmission of the information, and that, in addition, the control of the indication which appears on the known type boards is often carried out by an operator by means of a telecamera, and there is no automatic system for the control and the correction of the error in the display of the information on the board.

SUMMARY OF THE INVENTION

It is an object of the present invention to provide a teleindicator for information boards which will avoid most part of the disadvantages mentioned hereinabove, i.e. in which the power dissipated by the indicator board will on the average be low and substantially limited to the only period of updating of the indication, in which the updating will be carried out rapidly, which will be provided with considerably reduced number of connection cables, will allow a good legibility, and will, moreover, be provided with an indication checking system such as to allow an automatic correction of the error in the display of the information on the board.

Other objects and advantages of the teleindicator of the present invention, such as the structural simplicity, the limited weight and overall dimensions, the reduced wear and the negligible maintanance, will be apparent from the following description.

According to the present invention a teleindicator for information boards is provided, which is characterized in comprising first means for the registration of input signals relating to an indication which has to be displayed by the said teleindicator, second means arranged to process the signals from the said first means and arranged to control third means which actuate, in a mechanical way, the display of the said indication.

BRIEF DESCRIPTION OF THE DRAWINGS

For a better understanding of the present invention, two embodiments thereof will now be described, by way of non limiting examples, with reference to the accompanying drawings, in which.

DETAILED DESCRIPTION OF THE INVENTION

Figure 2:
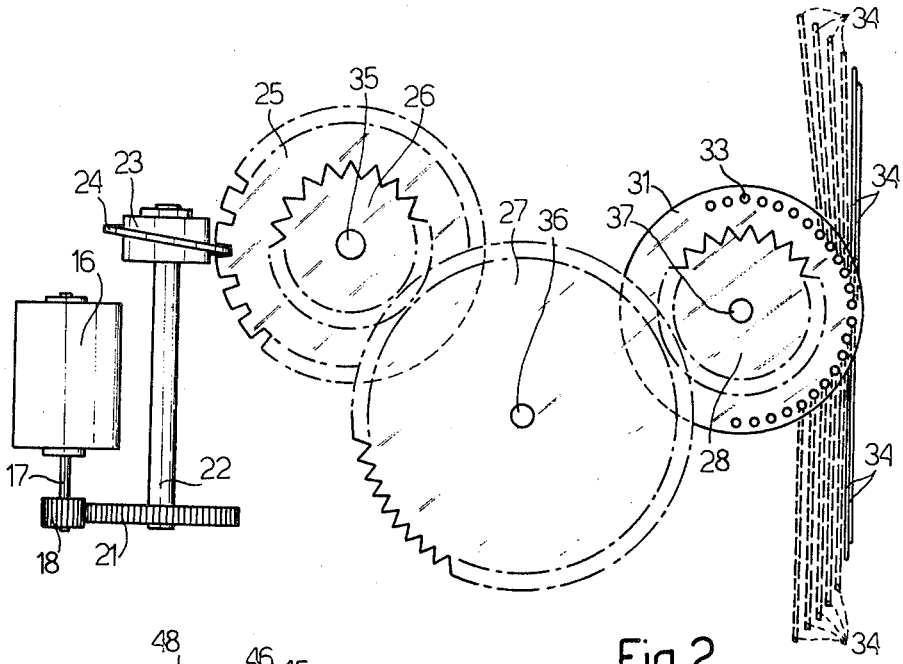
FIG. 2 is a diagrammatic view of some component elements of the teleindicator shown in FIG. 1.
Figure 1:
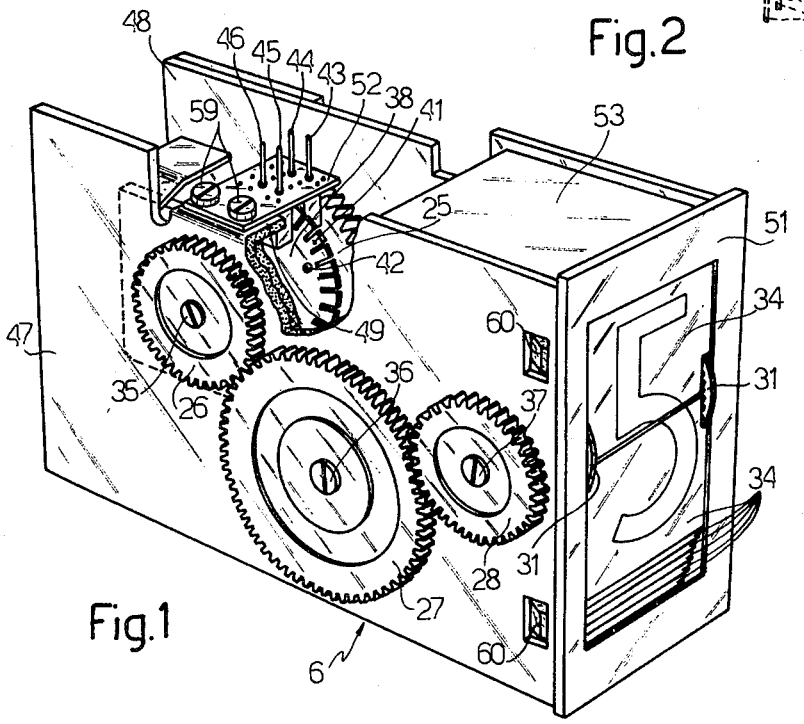
FIG. 1 is a perspective partially sectional front view of a first embodiment of the teleindicator forming the subject of the present invention.
Figure 3:
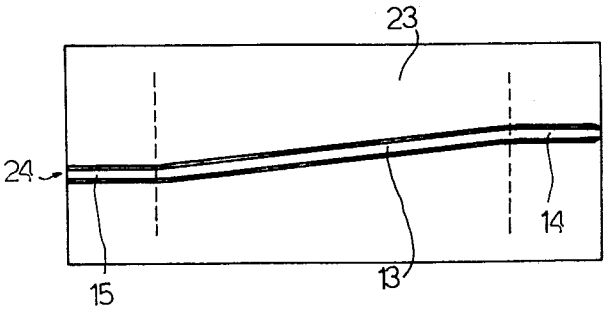
FIG. 3 is a plan view of the development of one of the component elements shown in FIG. 2.

Referring now to FIGS. 1, 2 and 3, reference numeral 16 indicates a direct current control motorfed by low voltage, for instance 24 Volt, which is provided with a rotating output shaft 17 having connected to its end a first gear 18 coupled with a second gear 21 keyed on an end of rotating shaft 22 which has its own axis parallel to the axis of the shaft 17. Keyed on a second end of the shaft 22 is a tubular element 23 which has on the side surface an endless screw 24 whose contour is shown in detail in FIG. 3 and which has a central section 13 gaving a constant inclination relative to the axis of the element 23, and two end sections 14 and 15 radiused to the central portion 13 and contained within planes perpendicular to the axis of the element 23.

The said endless screw 24 engages a gear 25 keyed on a rotating shaft 35, with the axis perpendicular to the axis of the shaft 22.

Keyed on the shaft 35 is a gear 26 which meshes with a gear 27 supported by a shaft 36. Gear 27 meshes with a gear 28 keyed on a rotatable shaft 37 having its axis parallel to the axis of the shaft 35. Keyed in a spaced relationship on the said shaft 37 are two discs 31 provided in a known manner, towards the perimetral edge, with a plurality of holes 33 having pivoted therein, at one of their edges, a plurality of movable plates 34 on which there are visible, in a known manner, component portions of letters or digits.

Referring now to FIG. 1, the teleindicator element 6 according to a first embodiment comprises two plane and parallel sidewalls 47 and 48 provided with holes having lodged therein the ends of the shafts 35, 36 and 37. The gears 26, 27 and 28 are disposed outside the wall 47, whilst the gear 25, and thus the motor 16 with the shafts 17 and 22, the gears 18 and 21 and the element 23 are disposed between the walls 47 and 48. The assembly of from motor 16 to element 23 is supported within the teleindicator element 6 in the manner shown in the drawing.

In the leading portion of the teleindicator element 6 there is disposed a frame 51 provided at its rear potion with the projections 60 for the fastening in a snap fashion to the walls 47 and 48. Generally, the said frame 51 is made of plastics and it is provided with an inner window which allows reading the indication supplied by the plates 34. Frame 51 may be of different colours and is easily extractable, by collapsing the projections 60, to allow obtaining a desired combination of colours in order to give a proper meaning to each indication.

Keyed on the shaft 35 between the gear 25 and the gear 26 is a disc 38 provided, towards its outer circumference, with a plurality of radial notches 41 and, on an inner circumference, with a hole 42. On one side of the said disc 38 there are disposed, corresponding to the notches 41 and the circumference having the hole 42 thereon, two photoemissive elements having respective signal pins 43 and 44, while two respective photoemissive elements having respective signal pins 45 and 46 are disposed on the opposite side of the disc 38, aligned with the respective photoemissive elements, parallel to the axis of the shaft 35. All these pins 43, 44, 45 and 46 are fixed onto an insulating board 52 fastened by means of screws 59 to a bent tab 49 of the wall 47. Finally, upper and lower (not visible) walls 53 are disposed between the walls 47 and 48 to form a protection box for the plates 34.

Figure 4:
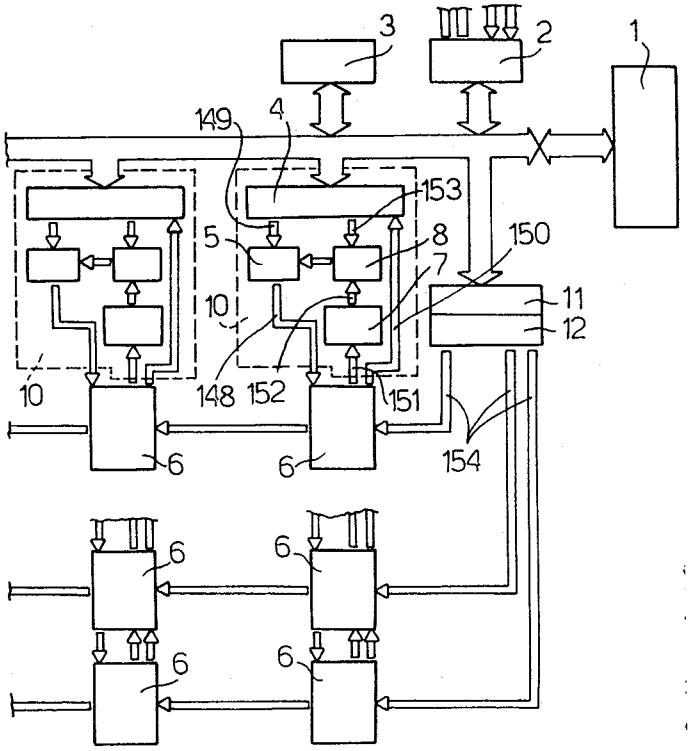
FIG. 4 is a block diagram of the control and checking circuit of the teleindicator shown in FIG. 1.

Referring to FIG. 4, there is shown, in the form of a block diagram, a control and checking circuit for a group of teleindicators according to the present invention.

These teleindicators, each of which is indicated by reference numeral 6, are disposed along a plurality of lines and columns to form together an information board.

Each column of these teleindicators 6 is controlled by a single control and checking assembly, indicated by reference numeral 10, which acts on teleindicators 6 of successive lines as will be described later. This control and checking unit 10 comprises a register 4 registering digital information, which register sends an activation signal to a block 5 which by means of signal 148 controls actuator means, in particular the motor 16. Thus, register 4 receives a signal 150 from the teleindicator 6 indicating the passage of the hole 42 for an initial reference position.

Teleindicator 6 sends also a signal 151, as a function of the rotation of the disc 38, to a counter 7 having a digital output signal 152 which is transmitted to an input of a comparator 8, whose other input receives a digital signal 153 from the register 4. The output of the comparator 8 is supplied to a second input of the block 5.

The described connections of the group 10 with the teleindicator 6, of course, are repeated between the same group 10 and the other teleindicators 6 of the same column.

The various registers 4 of the groups 10 of the various columns are connected, through connections means (BUS), to a microelaborator 1, which also is connected also to an interface 2 which exchanges information with a terminal, to board memory 3 and to digital line register 11 which sends information to a decoder 12 which by means of signals 154 controls the simultaneous updating of a single line of teleindicator elements 6, as will be better explained later.

Figure 5:
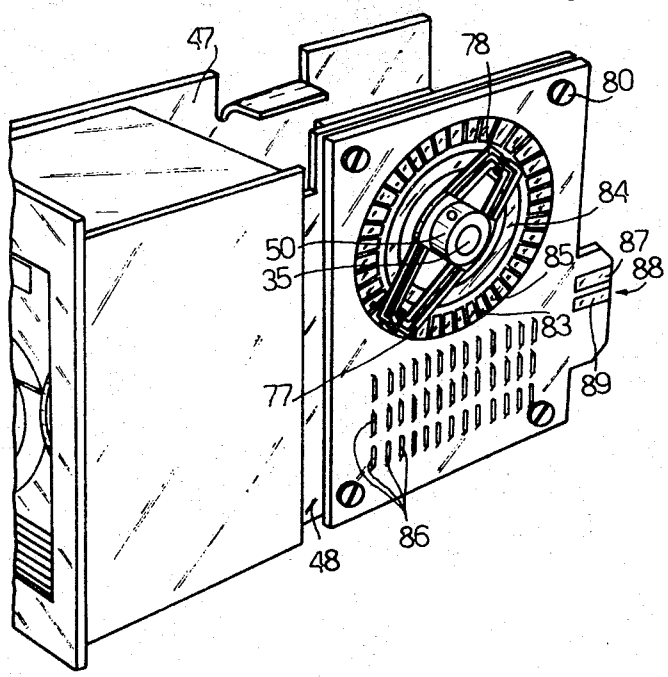
FIG. 5 is a partial side view of a second embodiment of a position control device for the teleindicator according to the present invention.

The embodiment shown in FIG. 5 differs from that of FIG. 1 by a different construction of the control device controlling the indication displayed. In fact, the disc 38 with the pairs of photoemissive and photodetecting elements are missing, and keyed on the shaft 35, outside the wall 48, is a tubular sleeve 50 carrying a first double brush 77, and a second double brush diametrally opposed and having a length smaller that that of the first brush. Double brush 77 slides on a copper plated annular path 83 formed by a plurality of contacts 85 each electrically separated from the adjacent contact and each electrically connected (by connection paths, not visible) to a resistor 86 of different value. Resistors 86 are connected at their other end (still by means of not visible connections paths) to a pin 89.

The second double brush 78 slides, instead, on an annular continuous copper plated path 84 which is connected, in a not visible manner, to a pin 87. The said paths 83 and 84, with the pins 87 and 89 and the resistors 86, are arranged on an insulating terminal board 88 which is fixed by means of screws 80 to the outer face of the wall 48.

Figure 6:
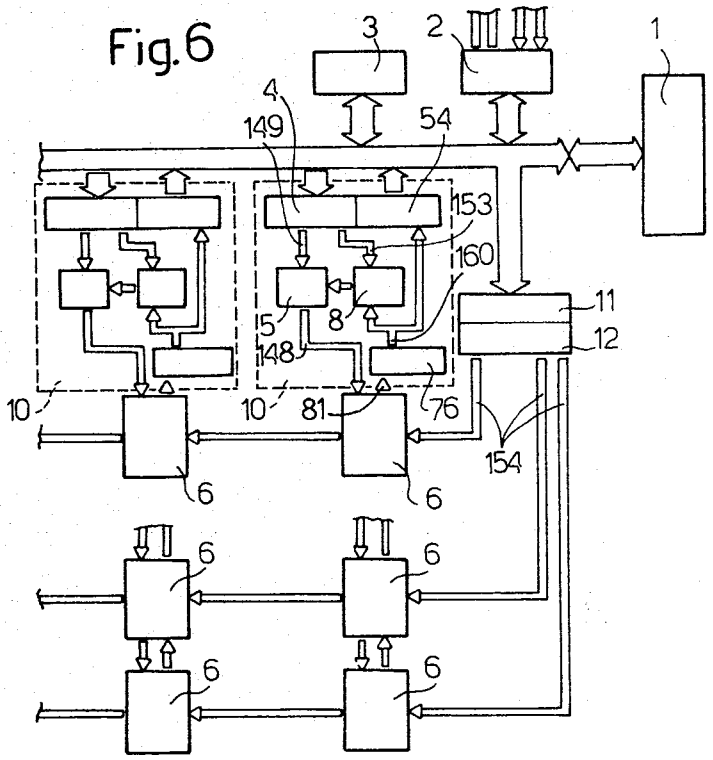
FIG. 6 is a block diagram of the control and checking circuit of the teleindicator, provided with the device shown in FIG. 5.

The block diagram of FIG. 6 differs from that of FIG. 4 in that the counter 7 is missing and that a block 76 is inserted which constitutes an analog-digital converter and which receives an analog signal 81 from the teleindicator 6 and supplies a digital signal 160 for the comparator 8 and for the interface 54 which through connection lines is connected to the microprocessor 1. Finally, signal 150 is missing.

With reference to the embodiment shown in Figures from 1 to 4, the operation of the teleindicator for information boards is as follows.

Interface 2, where the information signals for the board arrive from an outer terminal not shown in the drawing, sends this information to the microprocessor 1 which after having processed the information and after having stored the received information in the memory of the board 3, sends the signals relating to the indication which has to be displayed by the teleindicator 6, to the respective digital register 4 which, after the information has been charged, transmits the signal 148 to the motor control block 5 which controls, by means of the signal 148, the activation of the motor 16. Microprocessor 1 send also a line selection signal to the line register 11 which, through the decoder 12 by means of signal 154 gives the consent for the updating of a preselected line, for example by closing the consent contacts which consent the feeding of the motors 16 of the teleindicators 6 of a line. With the movement of the motor 16, by means of the gears 18 and 21 the shaft 22 is made to rotate. Shaft 22 rotates the endless screw 24 which produces also the rotation of the gear 25 and, consequently, the rotation of the gears 26, 27 and 28. Thus, the discs 31 rotate, which discs allow a different arrangement of the plates 34 for every about 10° rotation of the discs 31. When the inner hole 41 of the disc 38 is in a position corresponding to the photoemitter represented by the pin 43 and to the photodetector represented by the pin 45, the teleindicator element is reset, as an indication displayed by the plates 14, and transmits the reset signal 150 to the digital register 4 which sends to the comparator 8 the digital signal 153, which is a function of the number of notches 41, beginning from the resetting position, which have to be counted in order to arrive at the indication position required for the plates 34. In fact, the rotation of the discs 31 supporting the plates 34 takes place at the same time as the rotation of the disc 38 with the notches 41. Therefore, during the rotation of the disc 38, the notches 41 are detected by means of the photoemitter represented by the pin 44 and by means of the photodetector represented by the pin 46 which by means of the signal 151 send to the counter 7 the reference of the performed rotation of the discs 31. Counter 7 transmits the signal 152 to the comparator 8 which, by comparing the reference of the rotation of the disc 38 and, consequently, the rotation of the discs 31, with the rotations controlled by the digital register 4, upon obtaining the said equality, indicative of the presence of the required information on the plates 34, causes the block 5, by means of the signal 148, to stop the motor 16. Even though the motor 16 may, in such stop condition, be connected in short-circuit, by means of the circuit controlled by the signal 148, a certain degree of rotation may still take place, because of the inertia of the connected masses.

However, this reduced further rotation does not give rise to any rotational movement of the discs 31, owing to the particular configuration of the contour of the endless screw 24. In fact, by adjusting the angular position of the notches 41 so as to have, upon reaching the desired indication at the plates 34, an interruption of the feeding of the motor 23 when the endless screw 16 engages the gear 25 towards the beginning of its section 14, a rotation of the motor 16 and, consequently, of the shaft 22 and the endless screw 23 by about 120° does not produce any rotation of the gear 25, because only the sections 14 and 15 are engaged and no engagement with the inclined section 13 takes place.

Thus, the teleindicator according to the present invention allows obtaining a motion transmission coupling which is periodically inactive, and by interrupting the feeding of the motor in such period no problems due to a sudden locking of the transmission of the motion or problems in connection with the dissipation of the power of the motor arise. After the complete updating of the indications of the teleindicators 6 of a line of the board, by means of the microprocessor 1 new information will be transmitted to the digital registers 4 relating to the teleindicators 6 of a successive line, and new signals of consent for the updating of the indications of the said line, by means of the line register 11, so that the already described stages will be repeated.

FIG. 6 shows a block diagram which is different from the block diagram shown in FIG. 4 in that it utilizes a different device for the control of the position of the disks 31 and, thus, of the plates 34.

The device utilized for the block diagram shown in FIG. 6 is shown in FIG. 5.

In fact, between the pins 87 and 89 there is obtained, as a function of the position of the shaft 35 and, consequently, of the brushes 77 and 78, a voltage value which is a function of the resistance value of the resistor 86 connected by means of the said brushes 77 and 78. These values, and consequently these resistors 86, are as many as the plates 34, so that to each voltage value (signal 81) between the pins 87 e 89 corresponds a respective indication of the plates 34. Signal 81 (FIG. 6) is transmitted to the analogue-digital converter 76 which delivers the signal 150 which is transmitted to the comparator 8 and, through the interface 54, to the microprocessor 1, for the continuous indication of the position of the plates 34 to the microprocessor 1.

After having reached the required position, given by the coincidence aiwth the signal 153 from the digital register 4, comparator 8 controls the block 5 (which may comprise, for example, a bistable multivibrator) which by means of the signal 148 stops, as already discussed, the transmission of the movement to the discs 34.

Therefore, with the teleindicator according to the present invention, the consumption of electrical power results in being considerably reduced, because the power required for the control of the movement of the plates 34 is limited in time to the only period of updating of the indication, and, according to the embodiment shown in FIGS. 5 and 6, only for the teleindicators which actually have to change their indication.

Moreover, the updating operation is generally very rapid, owing to the high speed of the motor 16, and the positioning of the plates 34 at the exact indication desired is ensured by the particular profile of endless screw 23, which in addition allows to discharge the inertia of the motor 16 by a realtively simple construction, with a reduced cost of production, weight and overall dimensions.

Therefore, in an information board comprising even a considerable number of teleindicators according to the present invention, upon a command of updating the indication of the teleindicators of a line, these latter together modify their indications and no more in a serial manner; moreover, the high speed with which the microprocessor 1 may charge the registers 4 pertaining to the various teleindicators of a line, allows to utilize a very reduced number of connection cables through which passes serially, sequentially, the charge information for the various registers 4, till the signal 154 of simultaneous updating arrives for all the teleindicators 6.

Finally, with the teleindicator according to the present invention a good legibility of the indication is ensured, since this latter is expressed in digits or letters directly carried by the plates 34, and, in addition, there are provided the checking and an automatic correction of the display of the indication, by the use of the photodetectors 45 and 46 or the group of brushes 77 and 78 and the comparator 8.

Finally, it is clear that many modifications and variations may be made to the described embodiments of the teleindicators of the present invention, without departing from the scope and inventive idea of the invention.

For example, the control of the display of the indication, instead of being obtained by means of the analogue checking group shown in FIG. 5, could be obtained by means of a digitalchecking group, whose signals would be transmitted directly to the comparator 8. Such digital checking group could comprise rotating brushes, having a plurality of arms, cooperating with a respective plurality of sector paths, from which combinations of logic signals (given by presence or absence of a contact of the brushes with the paths) are obtained, as a function of the position of the brush and, consequently, of the shaft 35, which therefore are bound to the position of the plates 34.

Furthermore, the interruption of the motion of the motor 16 on the shaft 35 may be obtained by means of different systema of interruption.

I claim:

1. A teleindicator for information boards, comprising in combination, first means for the registration of input signals relating to an indication which has to be displayed by the said teleindicator, second arranged to process the signals from the said first means and arranged to control third means which actuate, in a mechanical way, the display of the said indication, by means of indicator elements, said third means comprising an electric motor and transmission mechanism for the transmission of the motion from the said motor to the said indicator means, characterized in that the said transmission mechanism comprise a mechanical transmission coupling periodically inactive while the electric motor is running, for the interruption of the transmission of the motion from the said motor to the said indicator elements, the said periodically inactive transmission coupling comprising an endless screw coupled to a gear, the profile of the said endless screw being such as to produce a rotation of the said gear only when corresponding to a section of the said profile.

2. A teleindicator as claimed in claim 1, characterized in that the profile of the said endless screw includes at least an inclined section and at least a section perpendicular to the axis of the said screw.

3. A teleindicator as claimed in claim 1, characterized in that the said second means control the disactivation so the said electric motor during the interval of time in which the said transmission coupling is inactive.

4. A teleindicator as claimed in claim 1, comprising a front frame for the said indicator elements characterized in that the said front frame is extractable from the said teleindicator.

5. A teleindicator as claimed in claim 1, characterized in that the said indicator elements are of the type having plates.

6. An information board, characterized in comprising a plurality of teleindicators as claimed in claim 1.

7. A board as claimed in claim 6, in which the said teleindicators are disposed according to a plurality of lines and columns, characterized in comprising single first and second means for the teleindicators of the same column, the said first and second single means controlling the said third means of teleindicators of different lines, through enable means for enabling teleindicators of preselected lines.

* * * * *